US005367312A

United States Patent [19]

Masters

[11] Patent Number: 5,367,312

[45] Date of Patent: Nov. 22, 1994

[54] BICONICAL DIPOLE ANTENNA

[75] Inventor: R. Wayne Masters, Falls Church, Va.

[73] Assignee: Antenna Research Associates, Inc.

[21] Appl. No.: 854,822

[22] Filed: Mar. 20, 1992

[51] Int. Cl.[5] ..... H01Q 9/28
[52] U.S. Cl. ..... 343/807; 343/808
[58] Field of Search ..... 343/807, 808, 773; H01Q 9/28

[56] References Cited

U.S. PATENT DOCUMENTS

| | | | |
|---|---|---|---|
| 2,175,254 | 10/1939 | Carter | 343/807 |
| 3,750,184 | 7/1973 | Kuecken | 343/807 |
| 4,125,840 | 11/1978 | Cassel | 343/807 |

FOREIGN PATENT DOCUMENTS

| | | | |
|---|---|---|---|
| 1020066 | 11/1957 | Germany | 343/807 |
| 675101 | 7/1952 | United Kingdom | 343/807 |

OTHER PUBLICATIONS

Singer et al., "Broadband Antenna for Field-Intensity Meters", Electronics, Feb. 1956, pp. 130–131.

*Primary Examiner*—Michael C. Wimer
*Attorney, Agent, or Firm*—Lane, Aitken & McCann

[57] ABSTRACT

A biconical antenna is used to measure the intensity of incident RF electrical fields. The antenna comprises a pair of aligned rods with wires distributed around the rods to define conical cavities around each of the rods. A ferrite choke surrounds each of the rods within the conical cavities to choke off residence within the cavities.

5 Claims, 4 Drawing Sheets

BICONICAL DIPOLE ANTENNA

This invention relates to biconical dipole antennas for measuring RF electric field intensity and, more particularly, to an improvement in such an antenna to improve its sensitivity in a range in which the sensitivity of the antenna is deficient.

BACKGROUND OF THE INVENTION

The biconical-dipole antenna is intended for use in determining the electric field intensity as a function of frequency at various short distances from an emanating source, such as a computer, or in environments where weak electromagnetic fields may exist. The antenna is calibrated in such a way that the measured output voltage across a specified resistive load (usually 50 ohms) yields the incident electric field intensity in volts per meter by way of a calibration curve. The calibration curve, called an antenna factor curve, usually expresses the ratio of the incident electric field intensity E in volts per meter to the output voltage $V_o$ (that is, the AFE) in decibels. The AFE thus enables the determination of E by the measurement of $V_o$. Mathematically stated, $$E(V/m)=V_o(V)\times AFE(m^{-1}), \quad (1)$$

from which by taking logarithms of each side times 20, one finds $$20 \log E(V/m)=20 \log V_o(V)+20 \log AFE(m^{-1}), \quad (2)$$

which, expressed in decibels (dB), reads $$E(\text{dB } V/m)=V_o(\text{dB } V)+AFE(\text{dB } m^{-1}), \quad (3)$$

In the above equations (1) through (3), the units of measurement are included inside the parentheses along with the decibel (dB) notation. The calibration curve gives the AFE in decibels for any frequency in the working range of the antenna. The accuracy of the antenna factor calibration is very important especially when limits are imposed on the allowable level of the incident field being measured.

A typical biconical-dipole antenna is specified in military standards bulletin MIL-STD 461. This antenna is intended to function from 20 MHz to 350 MHz. The calibration curve for this antenna exhibits a sharp peak, or suck-out, at 290 megahertz, indicating a sharp loss in sensitivity in the antenna. The exact frequency of this resonance will generally vary somewhat from one antenna to another of the same design because of manufacturing tolerances and/or proximity to other objects in the immediate vicinity. The greater the antenna factor becomes, the less becomes the sensitivity, or response, to a given signal. The sharpness of this so-called suck-out is very disconcerting to a user trying to determine the intensity of an existing field, or the existence of any field at all, at or near this frequency. The present invention is designed to overcome or minimize this loss of sensitivity.

SUMMARY OF THE INVENTION

The suck-out in the calibration curve is believed to be the result of a resonance inside the conical cage forming each half of the dipole, the resonant chamber being comprised of the center support rod working in conjunction with the surrounding cage somewhat in the nature of a closed section of coaxial transmission line.

Resonance is assumed to be induced by leakage through the wires of the cage. If the resonance could be prevented, the suck-out would be eliminated. The mere existence of a prominent resonance would sharply alter the driving point impedance of the dipole, thereby affecting the response adversely. Tests made in the laboratory confirm that a resonance actually does exist.

In accordance with the invention, the conical dipole antenna is provided with means to suppress or kill off the resonance that occurs within the cages of the dipole.

In accordance with one embodiment of the invention, the resonance is killed off by placing a choke on the inner support rod of the cage, effectively opening the conductor represented by the inner support rod against RF current flow. A choke consisting of a ferrite cylinder or sleeve placed on the support rod successfully eliminates the suck-out without otherwise altering the shape of the calibration curve. The exact location of the choke is not particularly critical, but a preferred location is near the base of the cone of the conical cage because the current inside the cavity at resonance is greatest at that point.

It is conceivable that opening the inner conductor might make possible a resonance and consequent suck-out at a lower frequency, since an open coaxial cavity will resonate at a lower frequency than a closed one of the same length. No such resonance has been found, presumably because the longer wavelength of the incident signal is much less able to penetrate the shield formed by the conical dipole elements, and because the phase difference between the sides of the cage is much less.

Another means for killing off the resonance is to sever the electrical connection in the conducting support rod axially centered in the conical cage so that current cannot flow, and restore the mechanical function of the rod by means of a dielectric cylinder or sleeves. Still another means would take the form of a conducting "spider" to place a short on the conical cavity at an intermediate point. A single conducting rod between the axial support rod and one element of the cage at an intermediate point would also serve to kill the resonance. These are more expensive measures because of the greater structural complexity.

DESCRIPTION OF THE PREFERRED EMBODIMENT

Figure 1:
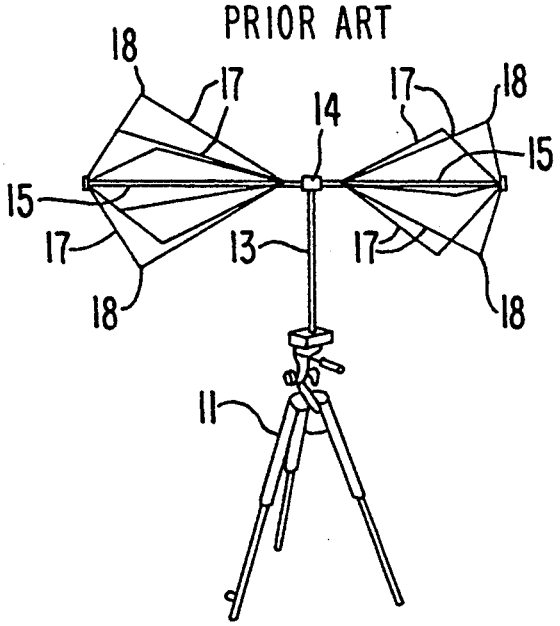
FIG. 1 PRIOR ART
FIG. 1 illustrates a prior art biconical antenna to which the present invention is applicable.
Figure 4:
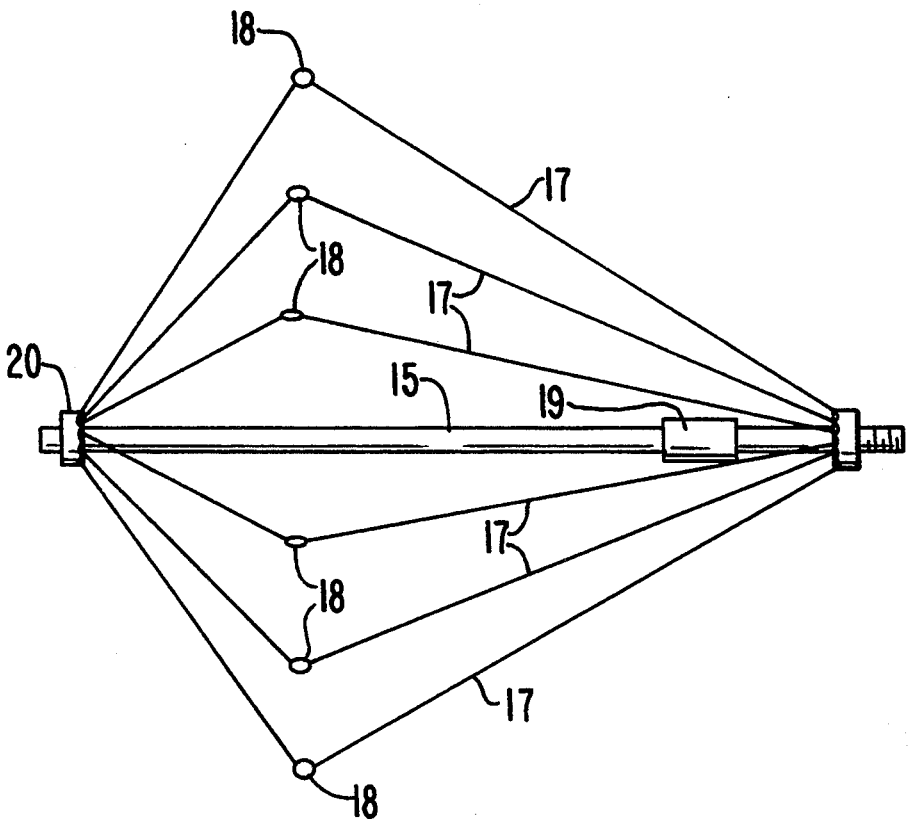
FIG. 4 illustrates one-half of the dipole antenna of FIG. 1 modified in accordance with a preferred embodiment of the invention.

As shown in FIG. 1, the biconical dipole antenna to which the present invention is applicable is mounted on a tripod 11 which supports a vertical mast 13. The mast 13 supports at junction 14 central horizontal rods 15 of the antenna extending to each half of the antenna dipole. The central supporting rods 15 extend to the end of each half of the dipole and each dipole half comprises a conical cage made up of a series of electrical conductors 17 distributed around the central rod 15 in each half of the dipole. Each conductor 17 has approximately a right angle bend 18 and, as best shown in FIG. 4, forms about a 60 degree angle with the rod 15 at the distal end thereof and a 30 degree angle with the rod 15 spaced a short distance from where the mast 15 supports the rod. In a collapsible model of the antenna, the right angle bends 18 are implemented by simple hinges, and the distal ends of the wire are hinged to a sleeve 20 slidable on the rod 15. In the specific prior art antenna described in MIL STD 461, there are six conductors 17 distributed around the central rod 15 at equal angles on each dipole.

Figure 2:
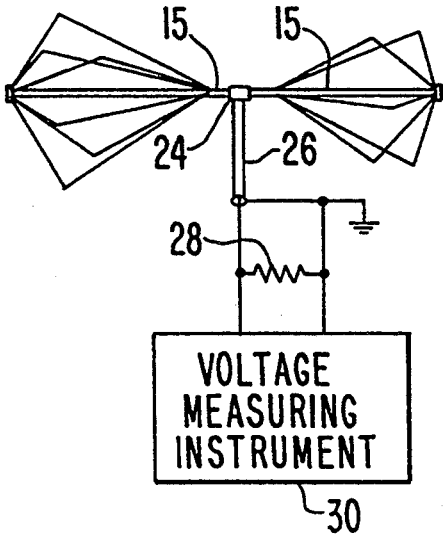
FIG. 2 PRIOR ART
FIG. 2 schematically illustrates the antenna of FIG. 1 connected in a circuit for measuring the output voltage of the antenna.

As shown in FIG. 2, each support rod 15 is electrically connected by means of a balun 24 to a coaxial cable 26 running through the vertical mast 13. The balun, which is located in the junction 14 between the support rods 15 and the mast 13, serves to match the balanced electrical circuit represented by the dipole antenna with the unbalanced circuit represented by the coaxial cable. A load resistance 28, e.g., 50 ohms, selected to match the characteristic impedance of the coaxial cable, is connected across the other end of the coaxial cable. A voltage measuring instrument 30 is connected to measure the output voltage produced across the resistor 28 at a selected frequency variable over the range 20 megahertz to 350 megahertz. This output voltage will provide an indication of the field intensity detected by the antenna at the selected frequency.

Figure 3:
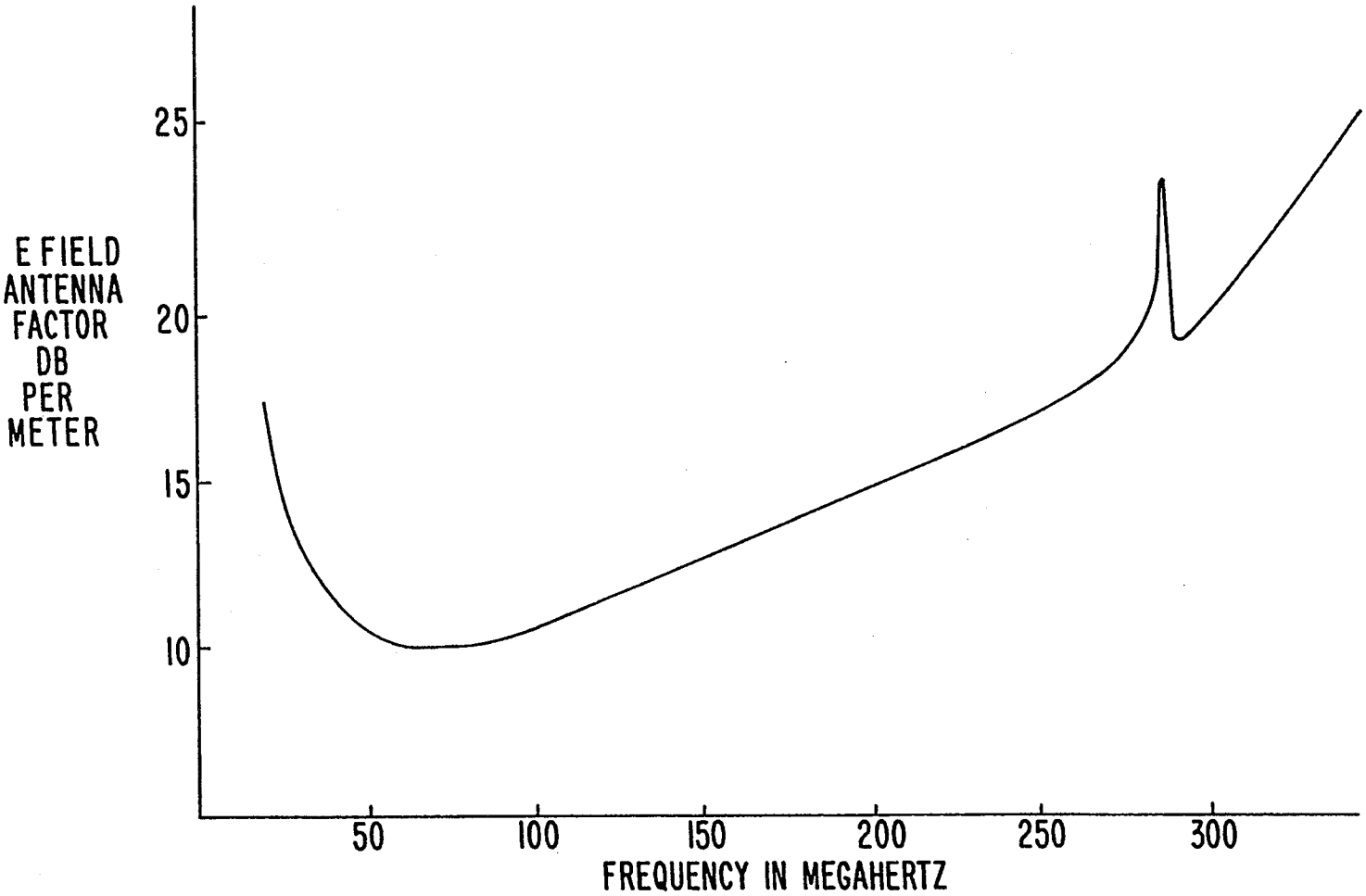
FIG. 3 PRIOR ART
FIG. 3 is a graph of a calibration curve or antenna factor curve for the antenna shown in FIG. 1.

The calibration curve shown in FIG. 3 illustrates how the ratio of the incident electrical field intensity in volts per meter to the output voltage $V_o$of the antenna across the load resistor 28 varies with the frequency of the incident electrical field with the ratio expressed in decibels. Taking the output voltage from the antenna at a given frequency and using the curve shown in FIG. 2, the electric field intensity can be determined over most of the frequency range from 20 megahertz to 350 megahertz. However, it should be noted that in this particular calibration curve, a sharp peak or suck-out occurs centered at 290 megahertz and extending over a band from about 280 megahertz to 295 megahertz. The presence of this peak in the calibration curve means that the curve does not provide an accurate measurement of field intensity in this frequency band.

The peak or suck-out centered near 290 megahertz is apparently caused by resonance which has been found to occur in each half of the dipole. The resonant chamber for the resonance comprises the center support rod 15 working in conjunction with the surrounding cage comprised of the wires 17 in a manner similar to a closed section of a coaxial transmission line.

In accordance with the present invention, as shown in FIG. 4, the resonance is killed off or suppressed by means of a ferrite choke 19 surrounding the rod 15 within the cage formed by the wires 17. FIG. 4 shows the choke 19 positioned in its approximate preferred location near the proximal end of the cage formed by the wires 17. Each half of the dipole will have a choke positioned as shown in FIG. 4. The presence of the choke surrounding the center rod 15 functions in effect to impose essentially an RF open circuit in the center rod 15 and, for this purpose, it is preferable that the choke provide a closed magnetic path extending around the center rod. As shown in FIG. 4, the choke 19 has a circular cross-section, but a circular shape is not essential.

Figure 5:
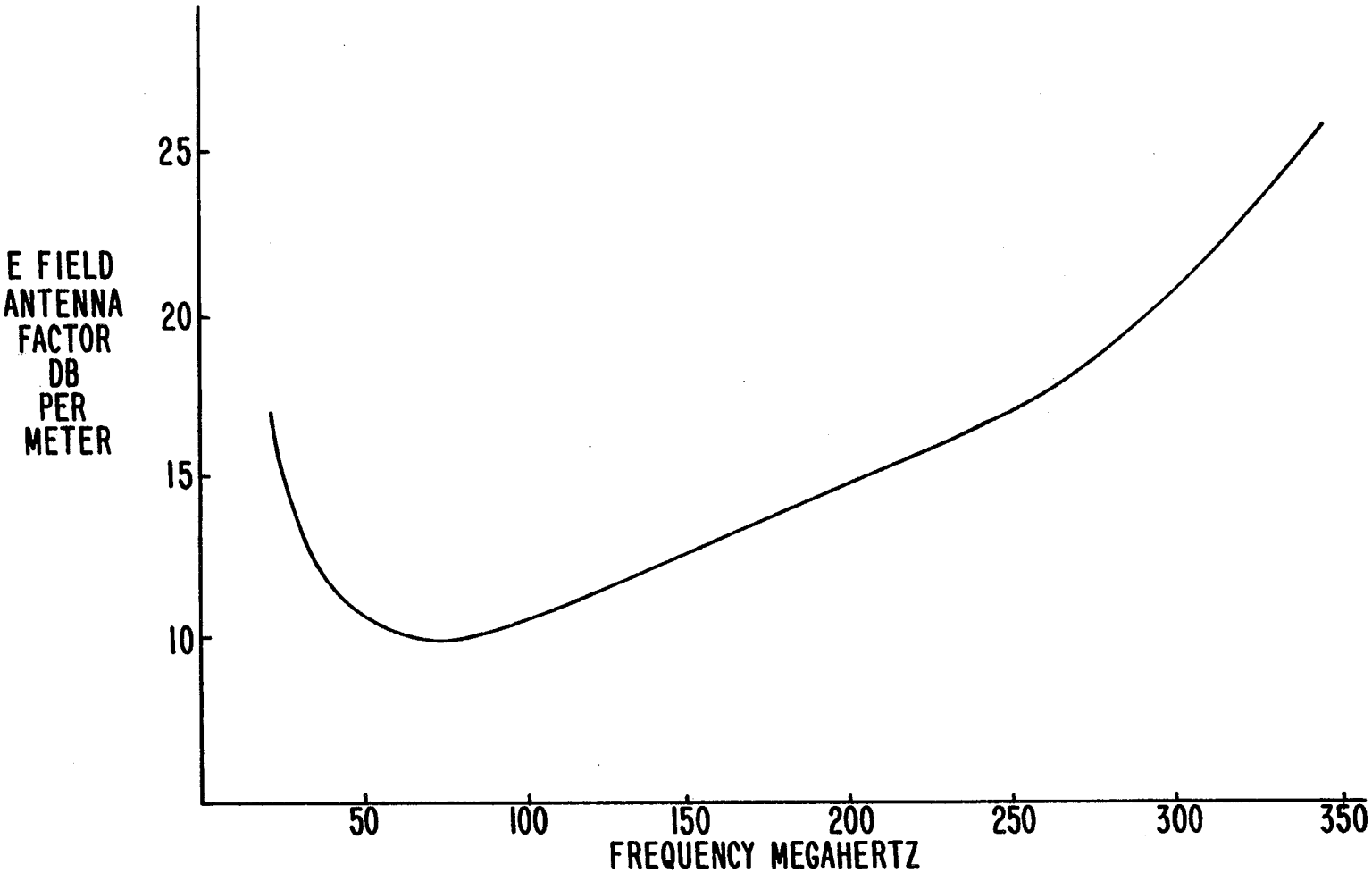
FIG. 5 is a graph of antenna factor curve for the antenna of FIG. 4.

FIG. 5 is a graph of the calibration curve of the antenna of the present invention with the ferrite chokes mounted on the central support rods in each half of the dipole as shown in FIG. 4. As shown in this graph, the peak or suck-out at 290 MHz in the curve has been effectively eliminated.

The ferrite choke is a preferred means to kill off the resonance occurring in the conical cavities of the dipoles of the antenna. However, other systems of killing off the resonance could be employed. For example, an electrical gap or opening could be provided in the support rod 15 within each cavity formed by each half of the dipole. Alternatively, a conducting spider or a single conducting rod could be provided within each conical cavity between the support rod and one or more wires of the cage. Such conducting structure would also serve to kill the resonance.

The above described alternatives would be more expensive than the ferrite choke because of the greater structural complexity required by such measures.

These and other modifications may be made without departing from the spirit and scope of the invention which is defined in the appended claims.

I claim:

1. In a biconical dipole antenna comprising a pair of electrically conducting support rods, each having a proximal and a distal end, a plurality of electrically conducting wires distributed around each end of each of said support rods, each wire having one end electrically connected to the distal end of the corresponding support rod and a second end electrically connected to the corresponding support rod at a location between said distal end and the proximal end of the rod, said wires being spaced uniformly around the corresponding support rod to define a conical cavity around each rod, and means for mounting said rods and wires in a dipole configuration, said dipole configuration producing an output voltage in response to incident radiation and being susceptible to resonance induced within each of said conical cavities by detected incident radiation and causing a sharp peak in the curve representing the variation with frequency of the ratio of the intensity of the incident electric field to output voltage from said dipole configuration, the improvement comprising means mounted in each of said cavities to suppress said resonance induced within said cavities by preventing resonant current flow in said rods.

2. A biconical dipole antenna as recited in claim 1, wherein said means to suppress resonance within each said cavity comprises a magnetic choke on the corresponding support rod and within each said conical cavity.

3. A biconical dipole antenna as recited in claim 2, wherein said choke comprises a ferrite choke.

4. A biconical dipole antenna as recited in claim 1, wherein said support rods are supported to be coaxial with each other by a mast at the proximal ends thereof, said mast being oriented orthogonally to said support rods.

5. A biconical dipole antenna as recited in claim 2, wherein said choke is located closer to the proximal end of each conical cavity than to the distal end.

* * * * *